US005772117A

United States Patent [19]

Su

[11] Patent Number: 5,772,117

[45] Date of Patent: Jun. 30, 1998

[54] WATER SPRINKLER

[76] Inventor: Yeong Chwan Su, No. 145, Sec. 2, Chyedong Road, Janghuah City, Janghuah County, Taiwan

[21] Appl. No.: 763,061

[22] Filed: Dec. 10, 1996

[51] Int. Cl.[6] ..... B05B 3/04

[52] U.S. Cl. ..... 239/240; 239/237; 239/263.3; 239/DIG. 1

[58] Field of Search ..... 239/225.1, 237, 239/240, 263.3, DIG. 1

[56] References Cited

U.S. PATENT DOCUMENTS

| | | | |
|---|---|---|---|
| 575,966 | 1/1897 | Main | 239/240 |
| 2,969,922 | 1/1961 | Butler | 239/237 X |
| 4,417,691 | 11/1983 | Lockwood | 239/DIG. 1 X |
| 4,848,662 | 7/1989 | Shevach | 239/237 X |
| 5,695,122 | 12/1997 | Messinger | 239/240 |

*Primary Examiner*—Andres Kashnikow
*Assistant Examiner*—Robin O. Evans
*Attorney, Agent, or Firm*—Pro-Techtor International Services

[57] ABSTRACT

A water sprinkler comprises a housing, a linking mechanism, a transmission rod, and a spray head. The housing is provided therein with a receiving compartment for housing the linking mechanism which is composed of a pump blade, a link wheel and an actuation wheel. The transmission rod is fastened at one end thereof with the actuation wheel and at another end thereof with the spray head having a plurality of jet nozzles for emitting a stream of water. The transmission rod is driven by the actuation wheel which is actuated by the pump blade. As the pump blade is driven by the incoming water current via an inlet of the housing, the spray head is actuated by the transmission rod to make a 360-degree roation so as to spray water in all directions.

4 Claims, 8 Drawing Sheets

PRIOR ART

WATER SPRINKLER

FIELD OF THE INVENTION

The present invention relates to a water sprinkler capable of spraying water evenly over a wide area.

BACKGROUND OF THE INVENTION

As shown in FIGS. 1 and 2, a water sprinkler of the prior art comprises a housing 10 which is provided with a water inlet 11, a water outlet 12, and a receiving compartment 13 having a through hole 131. The receiving compartment 13 is used to house a link gear set which is composed of a pump blade 14, a link wheel 15 and an actuating wheel 16. The pump blade 14 and the link wheel 15 are provided respectively with a threaded rod. the link wheel 15 and the actuating wheel 16 are respectively a bevel gear. The actuating wheel 16 is provided at one end thereof with four clamping pieces 161 extending outwardly. A transmission rod 17 is provided at one end thereof with a short suspension arm 171 which is fastened pivotally with a crank 172. The transmission rod 17 is provided in the outer surface thereof with a plurality of protruded strips 173 which are engaged with the clamping pieces 161. The crank 172 is fastened pivotally at another end thereof with a linking device 18, which is provided with a spray tube 19 connected with the water outlet 12 of the housing 10. The spray tube 19 is provided with a plurality of jet nozzles 191 for emitting a stream of water.

As illustrated in FIGS. 3 and 4, the pump blade 14 is actuated to turn by the force of water entering the housing 10 via the water inlet 11. As a result, the link wheel 15 and the actuating wheel 16 are actuated by the pump blade 14. The transmission rod 17 is thus actuated by the actuating wheel 16 to turn. The crank 172 is then actuated by the suspension arm 171 of the transmission rod 17. The linking device 18 is therefore driven by the crank 172 to rotate so as to cause the spray tube 19 to rotate within a range of 180 degrees to emit streams of water via the jet nozzles 191 of the spray tube 19.

Such a prior art water sprinkler as described above is defective in design in that it is too complicated in construction, and that its spraying range is confined to one half of a circle.

SUMMARY OF THE INVENTION

The primary objective of the present invention is therefore to provide an improved water sprinkler which is relatively simple in construction.

Another objective of the present invention is to provide an improved water sprinkler capable of spraying water in the range of a full circle.

In keeping with the principle of the present invention, the foregoing objective of the present invention are attained by a water sprinkler, which is composed of a housing for disposing a linking gear set. The linking gear set is actuated by a pump blade which is in turn actuated by the force of water entering the housing via a water inlet of the housing. A spray head is fastened with one end of a transmission rod which is driven by the linking gear set in such a manner that the spray head is capable of a 360-degree rotation.

DETAILED DESCRIPTION OF THE EMBODIMENT

Figure 1:
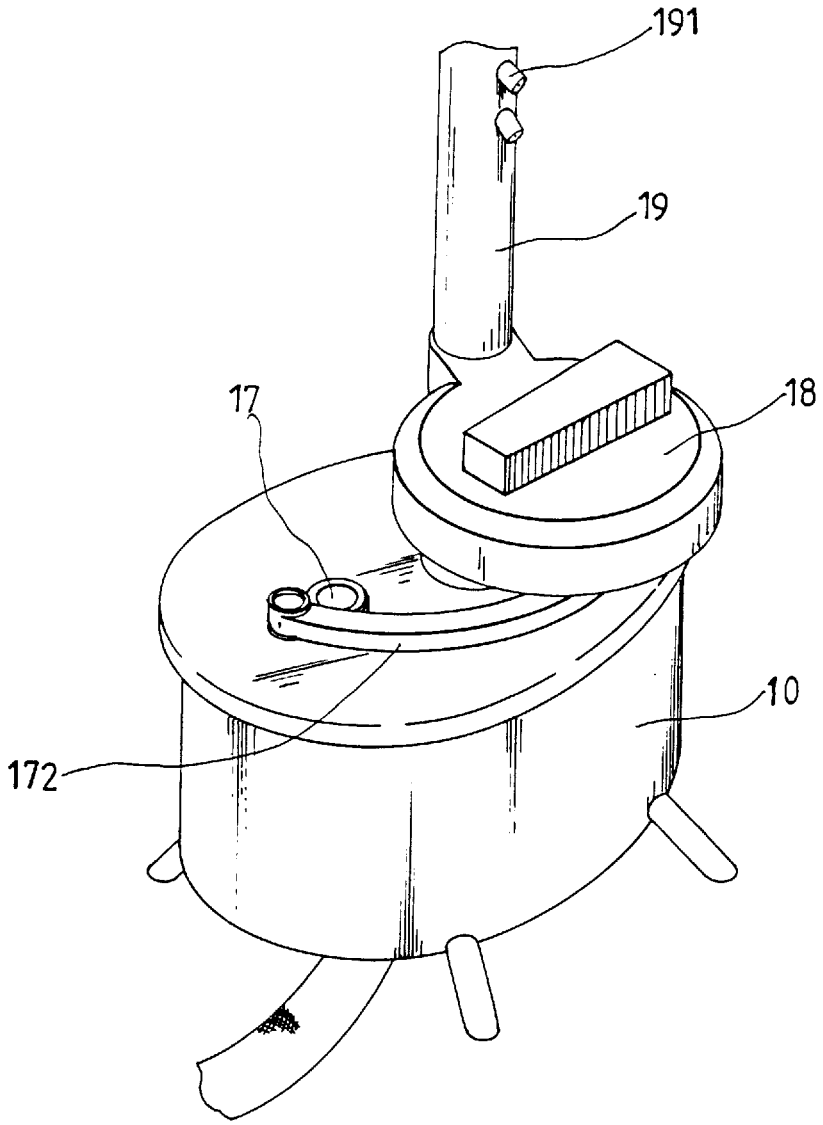
FIG. 1 shows a perspective view of a water sprinkler of the prior art.
Figure 2:
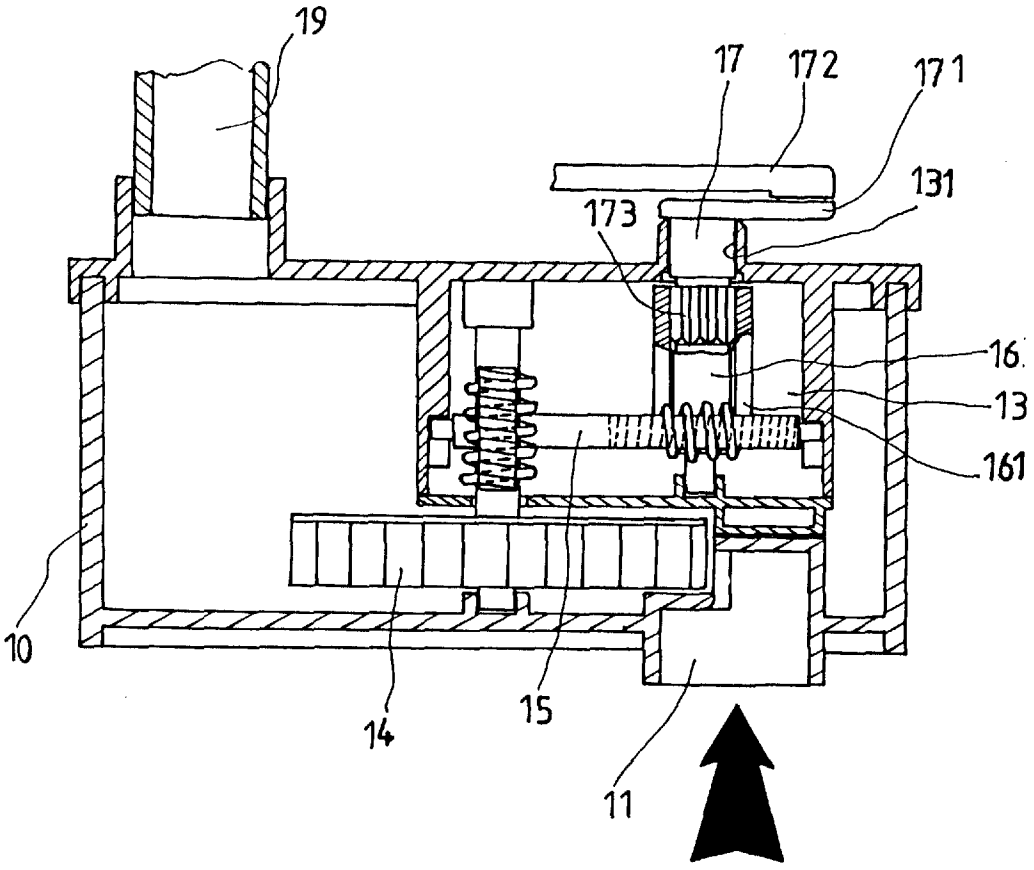
PRIOR ART FIG. 2
FIG. 2 shows a partial sectional view of the water sprinkler of the prior art.
Figure 3:
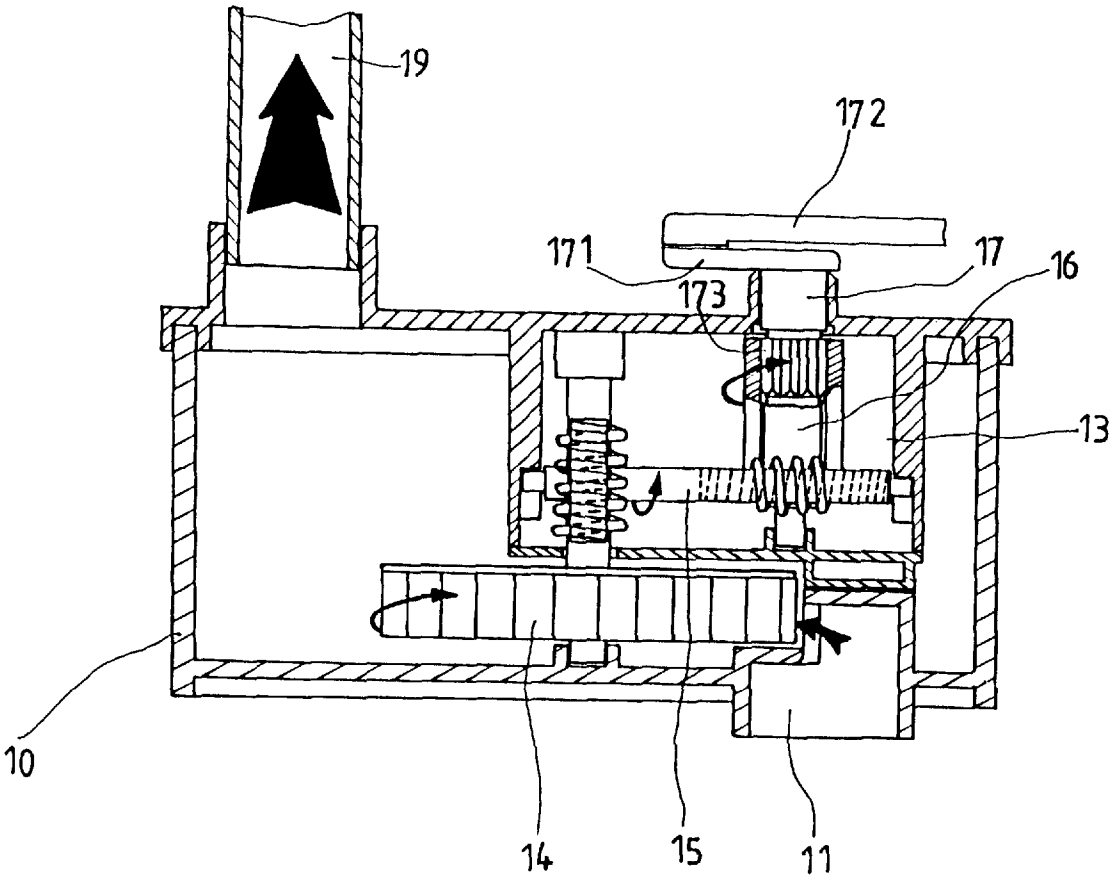
PRIOR ART FIG. 3
FIG. 3 is a sectional view to illustrate the operation of the water sprinkler of the prior art.
Figure 4:
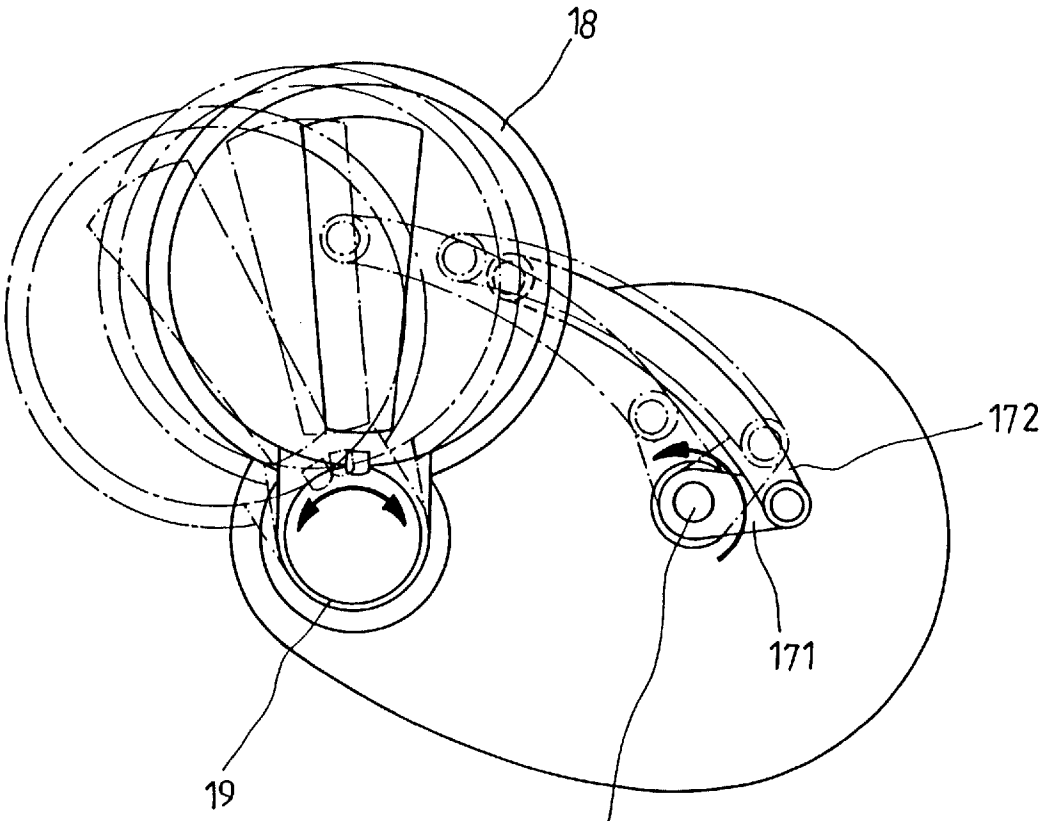
PRIOR ART FIG. 4
FIG. 4 is a plan view to illustrate the operation of the water sprinkler of the prior art.
Figure 5:
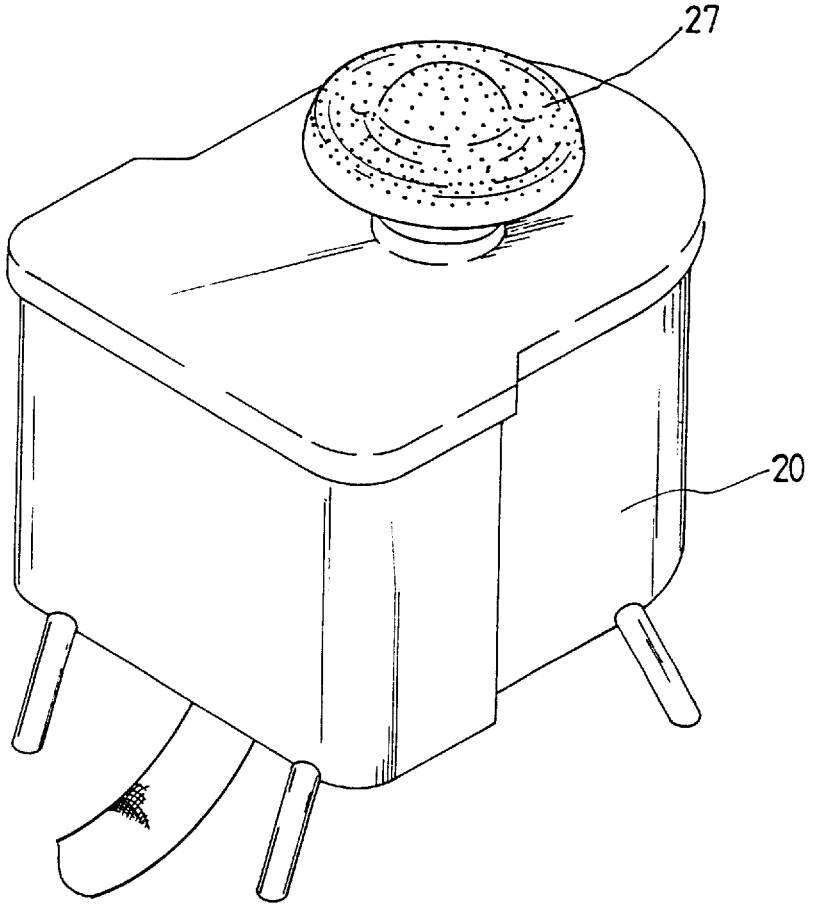
FIG. 5 shows a perspective view of a water sprinkler of the present invention.
Figure 6:
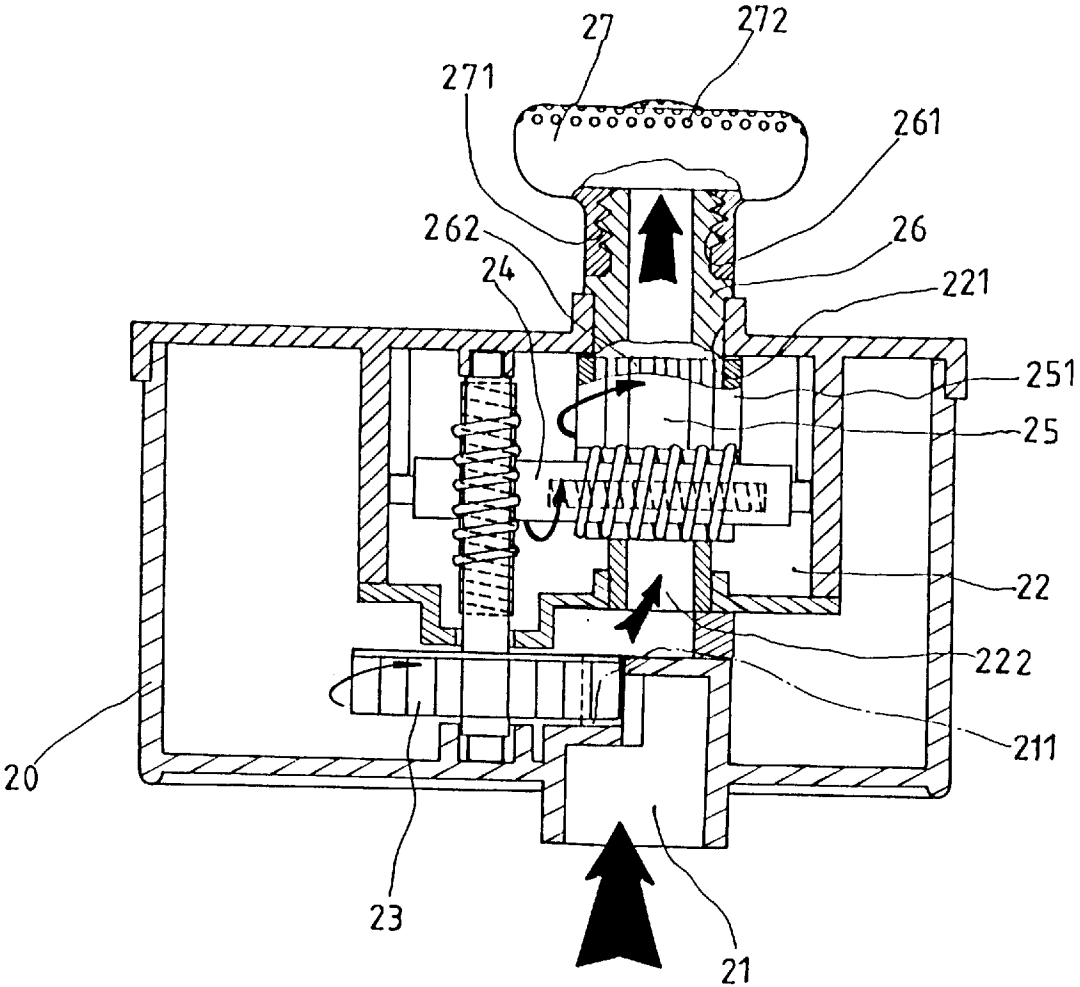
FIG. 6 shows a partial sectional view of the water sprinkler of the present invention.

As shown in FIGS. 5 and 6, a water sprinkler of the embodiment of the present invention comprises a housing 20, a pump blade 23, a link wheel 24, an actuation wheel 25, a transmission rod 26, and a spray head 27.

Figure 7:
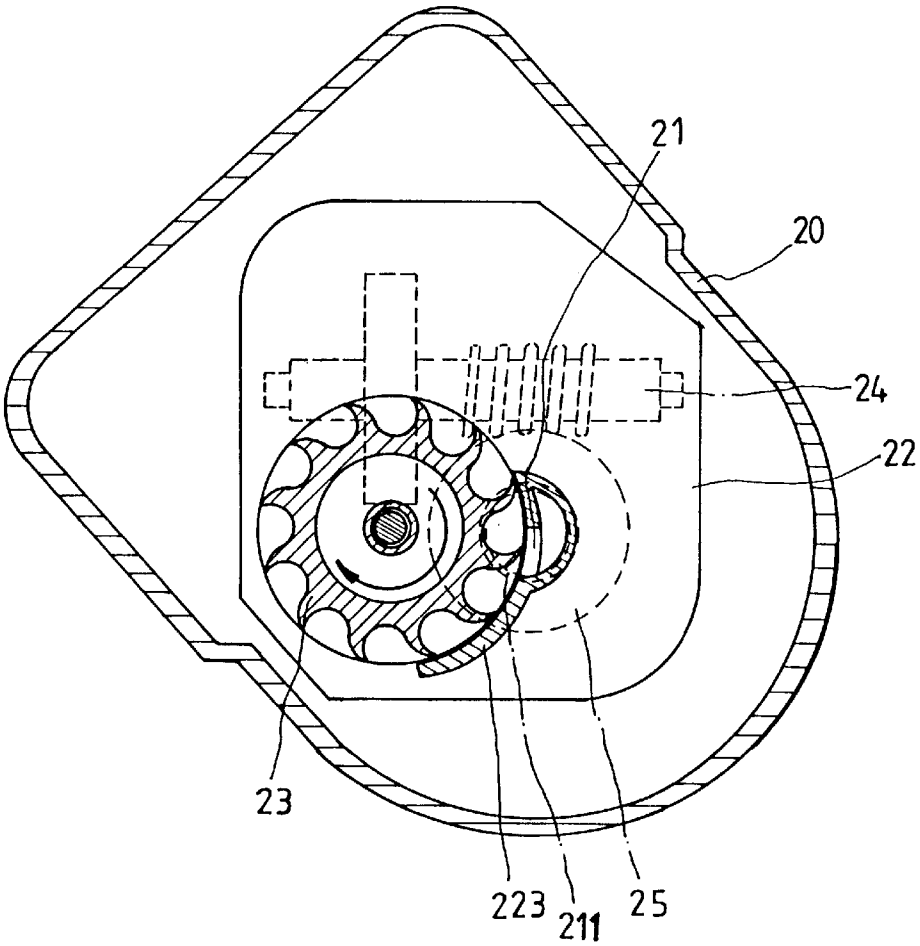
FIG. 7 is a sectional view to illustrate the operation of the water sprinkler of the present invention.
Figure 8:
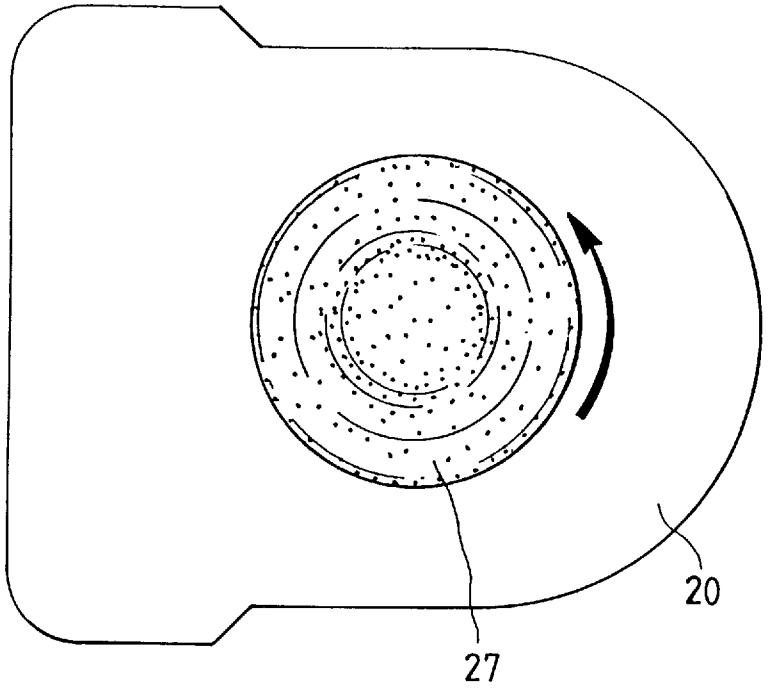
FIG. 8 is a plan view to illustrate the operation of the water sprinkler of the present invention.

The housing 20 is provided at the bottom thereof with an water inlet 21, and in the interior thereof with a receiving compartment 22 having a through hole 221. The pump blade 23, the link wheel 24, the actuation wheel 25, and the transmission rod 26 are located in the receiving compartment 22 of the housing 20. The pump blade 23 and the link wheel 24 are provided respectively with a threaded rod. The link wheel 24 and the actuation wheel 25 are respectively a bevel gear. The actuation wheel 25 is of a hollow construction and is provided with four clamping pieces 251 extending outwards. The transmission rod 26 is of a hollow tubular construction and is provided on the outer surface of one end thereof with an outer threaded portion 261, and on the outer surface of a body thereof with a plurality of protruded strips 262. The actuation wheel 25 and the transmission rod 26 are joined together such that the clamping piece 251 are engaged with the protruded strips 262, and that the body of the transmission rod 26 is put through the through hole 221 of the receiving compartment 22 of the housing 20. The spray head 27 has a tubular neck provided with an inner threaded portion 271, which is engaged with the outer threaded portion 261 of the transmission rod 26. The spray head 27 has a plurality of jet nozzles 272 opposite in location to the tubular neck of the spray head 27 for emitting a stream of water. It must be noted here that the receiving compartment 22 is provided in a side wal thereof with a water port 222 opposite in location to the center shaft of the actuation wheel 25. the housing 20 is provided in the inner wall surface thereof with a partition 211 located at the open end of the water inlet 21. The partition 211 is intended to guide the water current in such a manner that the pump blade 23 is driven by the water current to rotate clockwise, as illustrated in FIGS. 7 and 8. As a result, the link wheel 24 and the actuation wheel 25 are actuated by the pump blade 23 in motion. The transmission rod 26 and the spray head 27 are thus actuated by the actuation wheel 25 to make 360-degree rotation to enable the spray head 27 to emit the streams of water in all directions via the jet nozzles 272.

It is therefore readily apparent that the sprinkler of the present invention is relatively simple in design in that the spray head 27 is driven to make a 360-degree rotation by the transmission rod 26 which is in turn actuated by the actuation wheel 25. As a results the water sprinkler of the present invention is capable of spraying water in all directions.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A water sprinkler comprising:

a housing provided with an water inlet and a receiving compartment having a through hole;

a linking mechanism located in said receiving compartment of said housing and composed of a pump blade, a link wheel and an actuation wheel having a clamping device;

a transmission rod having one end which is engaged with said clamping device of said actuation wheel, said transmission rod further having another end and a body portion which is put through said through hole of said receiving compartment of said housing; and a spray head having one end fastened with said another end of said transmission rod, said spray head further having another end provided with a plurality of jet nozzles for emitting a stream of water;

wherein said pump blade is actuated to rotate clockwise by the water current entering said housing via said water inlet of said housing; wherein said link wheel and said actuation wheel are driven by said pump blade to make a 360-degree rotation so as to enable said transmission rod and said spray head to make a 360-degree rotation.

2. The water sprinkler as defined in claim 1, wherein said clamping device of said actuation wheel comprises a plurality of clamping pieces; and wherein said one end of said transmission rod is provided with a plurality of protruded strips engaged with said clamping pieces of said actuation wheel.

3. The water sprinkler as defined in claim 1, wherein said housing is provided therein with a partition opposite in location to said pump blade for guiding the water current in such a manner that said pump blade is driven by the water current to rotate closkwise.

4. The water sprinkler as defined in claim 1, wherein said link wheel and said actuation wheel are respectively a bevel gear.

* * * * *